US009575498B2

(12) United States Patent
Peluso et al.

(10) Patent No.: US 9,575,498 B2
(45) Date of Patent: Feb. 21, 2017

(54) LOW DROPOUT REGULATOR BLEEDING CURRENT CIRCUITS AND METHODS

(71) Applicant: QUALCOMM Incorporated, San Diego, CA (US)

(72) Inventors: Vincenzo Peluso, San Diego, CA (US); Bing Liu, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 58 days.

(21) Appl. No.: 14/609,155

(22) Filed: Jan. 29, 2015

(65) Prior Publication Data

US 2016/0224040 A1 Aug. 4, 2016

(51) Int. Cl.

| | |
|---|---|
| ***G05F 3/26*** | (2006.01) |
| ***G05F 3/16*** | (2006.01) |
| ***G05F 1/575*** | (2006.01) |

(52) U.S. Cl.

CPC ..... *G05F 1/575* (2013.01); *G05F 3/16* (2013.01); *G05F 3/26* (2013.01); *G05F 3/262* (2013.01)

(58) Field of Classification Search

CPC ..... G05F 3/26; G05F 3/262; G05F 3/16
See application file for complete search history.

(56) References Cited

U.S. PATENT DOCUMENTS

| | | | | |
|---|---|---|---|---|
| 3,322,972 | A | 5/1967 | Csanky | |
| 6,861,832 | B2 | 3/2005 | Perez | |
| 8,076,985 | B2 | 12/2011 | Tsukizawa | |
| 2008/0042732 | A1* | 2/2008 | Bowers | G05F 3/26 327/538 |
| 2008/0284502 | A1* | 11/2008 | Chen | G05F 3/267 327/541 |
| 2010/0289472 | A1 | 11/2010 | Renous | |
| 2012/0223688 | A1* | 9/2012 | Iriarte | G05F 3/262 323/280 |
| 2013/0307506 | A1 | 11/2013 | Oh et al. | |
| 2014/0247087 | A1 | 9/2014 | Bhattad et al. | |
| 2016/0124454 | A1* | 5/2016 | Chellappa | G05F 3/262 323/315 |

FOREIGN PATENT DOCUMENTS

| | | |
|---|---|---|
| EP | 1806640 A2 | 7/2007 |

OTHER PUBLICATIONS

Rincon-Mora G.A., "Current Efficient, Low Voltage, Low Dropout Regulators," Nov. 1996, 198 pages.

(Continued)

*Primary Examiner* — Timothy J Dole
*Assistant Examiner* — Ishrat Jamali
(74) *Attorney, Agent, or Firm* — Haynes and Boone, LLP

(57) ABSTRACT

The present disclosure includes circuits and methods for generating bleeding currents. In one embodiment, a pass transistor of a voltage regulator receives a voltage from a feedback circuit. A negative resistance circuit is coupled to a node to produce a bleeding current that turns on when needed and is otherwise off to save power. In one embodiment, the negative resistance circuit includes stacked current mirrors and a resistor. In another embodiment, the resistor has a first terminal that receives the voltage from the feedback circuit and a second terminal is coupled to a constant reference voltage that tracks the input voltage.

14 Claims, 7 Drawing Sheets

(56) References Cited

OTHER PUBLICATIONS

International Search Report—PCT/US2016/014472—ISA/EPO—Aug. 22, 2016.
Written Opinion—PCT/US2016/014472—ISA/EPO—Aug. 22, 2016.
Yuk Y-S., et al., "A CMOS LDO Regulator with High PSR using Gain Boost-Up and Differential Feed Forward Noise Cancellation in 65nm Process", Proceedings of the ESSCIRC (ESSCIRC), IEEE, Sep. 17, 2012 (Sep. 17, 2012), pp. 462-465, XP032466542, DOI: 10.1109/ESSCIRC.2012.6341355, ISBN: 978-1-4673-2212-6.
Yuk Y-S., et al., "PSR Enhancement Through Super Gain Boosting and Differential Feed-Forward Noise Cancellation in a 65-nm CMOS LDO Regulator", Oct. 1, 2014 (Oct. 1, 2014), IEEE transactions on Very Large Scale Integration (VLSI) Systems, IEEE Service Center, Piscataway, NJ, USA, pp. 2181-2191, XP011559884, ISSN: 1063-8210.

* cited by examiner

LOW DROPOUT REGULATOR BLEEDING CURRENT CIRCUITS AND METHODS

BACKGROUND

The present disclosure relates to electronic circuits and methods, and in particular, to low dropout regulator bleeding circuits and methods.

Voltage regulators are circuits that produce constant output voltages across a range of output currents. Such circuits are commonly used in electronic systems to provide a constant supply voltage to circuits that may draw different currents during various modes of operation. Low dropout (LDO) voltage regulators typically have a small difference between the input voltage applied to the voltage regulator and the output voltage produced by the voltage regulator.

FIG. 1 illustrates a typical LDO voltage regulator. LDO voltage regulator 100 receives an input voltage Vin on a first terminal of a pass transistor M7 and produces a regulated output voltage Vout on a second terminal of the pass transistor. Vout is sensed through a resistor divider (e.g., R1 and R2) coupled to one input of a differential amplifier comprising transistors M1, M2, M3, and M4. The other input of the differential circuit is coupled to a reference voltage Vref. M3 and M4 form a current mirror load. An output of the differential circuit is coupled to a common source circuit comprising transistor M5 to produce a voltage at node n3.

For nominal current loads, the gate of pass transistor M7 is driven by diode configured transistor M6. At nominal output currents, the impedance of M6 is sufficiently low to drive the gate of pass transistor M7. However, at low output currents, the drive impedance of M6 may become insufficient to drive the gate of pass transistor M7. To provide a low impedance to stabilize the loop, a natural device M8 with a low threshold voltage, Vt, is sometimes provided. M8 provides bleeding current into node n3 at low output currents when the voltage at n3 (and the gate of the pass device M7) is higher than a threshold Vt below the input voltage Vin, where M6 starts to turn off.

One problem with existing bleeding current techniques is that M8 may pass larger currents as the voltage on node n3 drops. For example, when the voltage on node n3 drops below Vin−Vt, M6 is fully on and provides a low impedance to drive M7, but the current in M8 increases dramatically as the voltage on node n3 goes down. FIG. 2 illustrates the increase in bleeding current in some existing LDOs. As the current through pass device M7 increases, or as the Vds goes down (when M7 is operating in the linear region as in the dropout mode of operation), the gate to source voltage, Vgs of M7 needs to grow to pass the required current. Thus, the gate voltage may be pulled down by the feedback loop, and the bleeding current through M8 may rise to unacceptably high levels as illustrated in FIG. 2.

SUMMARY

The present disclosure includes circuits and methods for generating bleeding currents. In one embodiment, a pass transistor of a voltage regulator receives a voltage from a feedback circuit. A negative resistance circuit is coupled to a node to produce a bleeding current that turns on when needed and is otherwise off to save power. In one embodiment, the negative resistance circuit includes stacked current mirrors and a resistor. In another embodiment, the resistor has a first terminal that receives the voltage from the feedback circuit and a second terminal is coupled to a constant reference voltage that tracks the input voltage.

In one embodiment, the present disclosure includes a circuit comprising a pass transistor having a control terminal, a first terminal, and a second terminal, wherein the first terminal is coupled to receive an input voltage, a regulator feedback control circuit having a first input coupled to the second terminal of the pass transistor and an output coupled to the control terminal of the pass transistor, and a negative resistance circuit coupled to the control terminal of the pass transistor.

In one embodiment, a current from the negative resistance circuit to the control terminal of the pass transistor decreases as a voltage on the control terminal of the pass transistor decreases below a first value.

In one embodiment, the current from the negative resistance circuit to the control terminal of the pass transistor increases as a voltage on the control terminal of the pass transistor approaches a threshold voltage below the input voltage.

In one embodiment, the current from the negative resistance circuit to the control terminal of the pass transistor decreases as a voltage on the control terminal of the pass transistor approaches the input voltage.

In one embodiment, the negative resistance circuit comprises a first transistor having a control terminal, a first terminal, and a second terminal, wherein the first terminal is coupled to the control terminal and the second terminal is coupled to the control terminal of the pass transistor, a second transistor having a control terminal, a first terminal, and a second terminal, wherein the first terminal is coupled to the first terminal of the first transistor and the second terminal is coupled to the input voltage, a third transistor having a control terminal, a first terminal, and a second terminal, wherein the first terminal is coupled to the control terminal, the second terminal is coupled to the input voltage, and the control terminal of the third transistor is coupled to the control terminal of the second transistor, a fourth transistor having a control terminal, a first terminal, and a second terminal, wherein the second terminal is coupled to the second terminal of the third transistor, the control terminal is coupled to the control terminal of the first transistor, and the first terminal is coupled to through a resistor to a reference voltage.

In one embodiment, the reference voltage is ground.

In one embodiment, the reference voltage is a constant reference voltage that tracks the input voltage.

In one embodiment, the resistor is coupled to a reference generator circuit that maintains a constant voltage difference between the input voltage and the reference voltage.

In one embodiment, the circuit further comprises a fifth transistor, wherein the fifth transistor has a control terminal coupled to the reference voltage, a first terminal coupled to the control terminal of the third transistor and the first terminal of the fourth transistor, and a second terminal coupled to the first terminal of the third transistor.

In one embodiment, the reference generator circuit comprises a source follower having an input and an output, where the input is coupled to a second reference voltage that tracks the input voltage and the output is coupled to the resistor to produce the reference voltage, and a plurality of transistors comprising a current feedback loop around the source follower to produce a low impedance at the output of the source follower.

In another embodiment, the present disclosure includes a method comprising coupling an input voltage from a first terminal of a pass transistor to produce an output voltage on a second terminal of the pass transistor, coupling the output voltage to a regulator feedback control circuit having a first input coupled to the second terminal of the pass transistor and an output coupled to a control terminal of the pass transistor, and generating a bleeding current from a negative resistance circuit to a node coupled to the control terminal of the pass transistor.

In one embodiment, the bleeding current from the negative resistance circuit to the node decreases as a voltage on the node decreases below a first value.

In one embodiment, the bleeding current from the negative resistance circuit to the node increases as a voltage on the node approaches a threshold voltage below the input voltage.

In one embodiment, the bleeding current from the negative resistance circuit to the node decreases as a voltage on the node approaches the input voltage.

In one embodiment, generating the bleeding current comprises generating a voltage on a first terminal of a resistor approximately equal to a voltage on the node, and in accordance therewith, generating a resistor current and mirroring the resistor current to the node.

In one embodiment, a second terminal of the resistor is coupled to ground.

In one embodiment, a second terminal of the resistor is coupled to a constant reference voltage that tracks the input voltage.

In another embodiment, the present disclosure includes a circuit comprising pass transistor means for receiving an input voltage and producing an output voltage, feedback control means for receiving the output voltage and controlling a control terminal of the pass transistor means to regulate the output voltage, and means for producing a negative resistance bleeding current to a node coupled to the control terminal of the pass transistor means.

In one embodiment, means for producing a negative resistance bleeding current comprises means for reflecting a voltage on the node to a first terminal of a resistor to generate a resistor current and means for mirroring the resistor current to the node.

In one embodiment, the circuit further comprises means for generating a constant reference voltage that tracks the input voltage on a second terminal of the resistor.

The following detailed description and accompanying drawings provide a better understanding of the nature and advantages of the present disclosure.

DETAILED DESCRIPTION

The present disclosure pertains to LDO bleeding current circuits and methods. In the following description, for purposes of explanation, numerous examples and specific details are set forth in order to provide a thorough understanding of the present disclosure. It will be evident, however, to one skilled in the art that the present disclosure as expressed in the claims may include some or all of the features in these examples alone or in combination with other features described below, and may further include modifications and equivalents of the features and concepts described herein.

Embodiments of the present disclosure include a regulator circuit with a pass transistor, a regulator feedback control circuit, and a negative resistance circuit. A first terminal of the pass transistor is coupled to receive an input voltage, Vin. The regulator feedback control circuit has a first input coupled to a second terminal of the pass transistor and an output coupled to the control terminal of the pass transistor. A negative resistance circuit is coupled to the control terminal of the pass transistor. In one embodiment, a current from the negative resistance circuit to the control terminal of the pass transistor decreases as a voltage on the control terminal of the pass transistor decreases.

Figure 1:
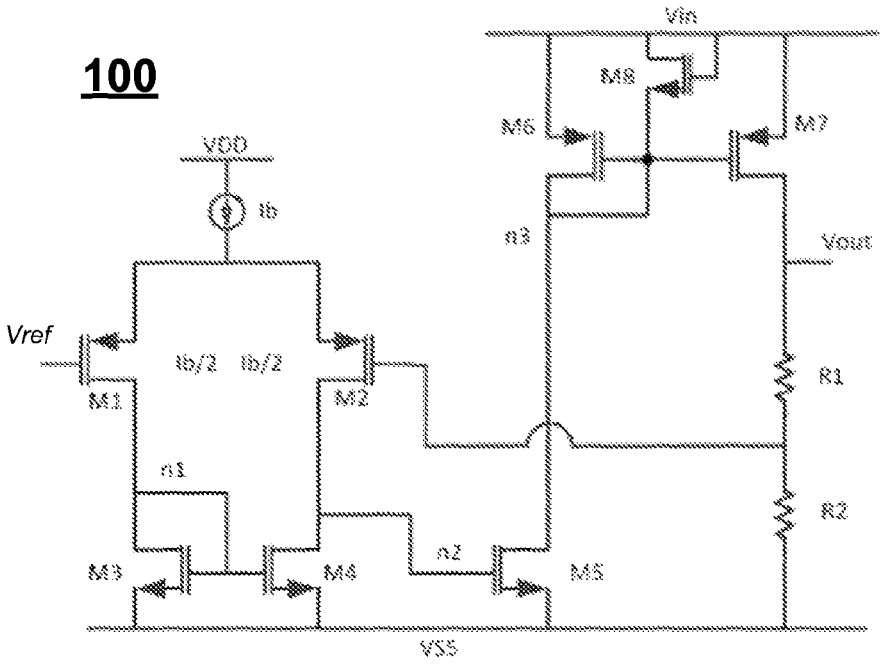
Fig. 1 (Prior Art)
FIG. 1 illustrates a typical LDO voltage regulator.
Figure 2:
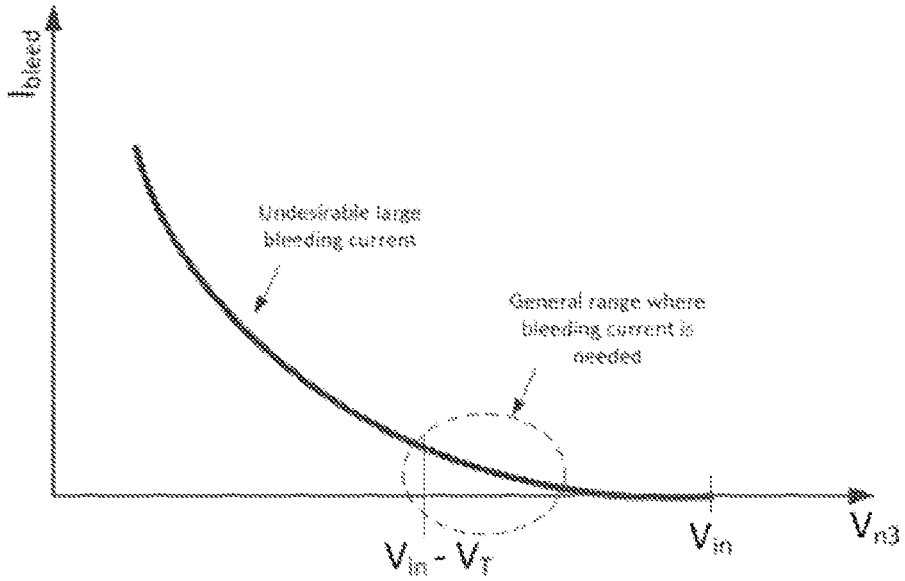
Fig. 2 (Prior Art)
FIG. 2 illustrates increasing bleeding current in an existing LDO voltage regulator.
Figure 3:
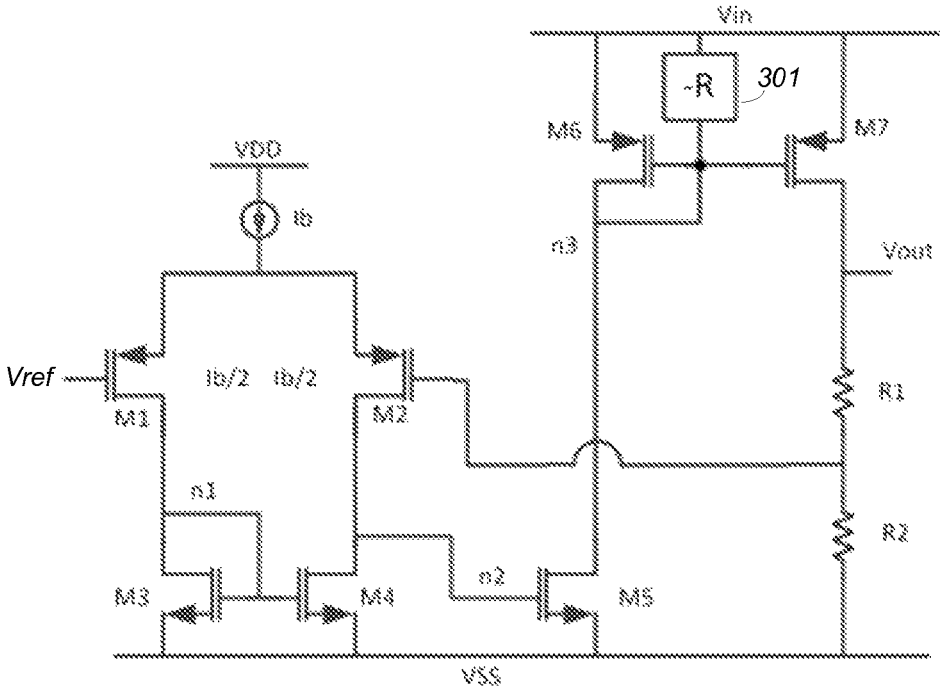
FIG. 3 illustrates an LDO regulator including a negative resistance circuit according to one embodiment.

FIG. 3 illustrates an LDO regulator including a negative resistance circuit according to one embodiment. In this example, a pass transistor M7 is a PMOS transistor having a source coupled to an input voltage, Vin. The output of the regulator is taken at the drain of M7, which produces a regulated output voltage, Vout. In one example embodiment, M7 may provide a mechanism for receiving an input voltage and producing an output voltage. In this example, regulator feedback control circuitry includes a resistor divider (e.g., R1 and R2), transistors M1, M2, M3, and M4 configured as a differential amplifier (M1/M2) and current mirror load (M3/M4), and transistor M5 and M6 which drive a voltage to the gate of M7 at node n3. In this example, transistors M1-M5 provide a mechanism for receiving the output voltage and controlling a control terminal of the pass transistor. In this example, a negative resistance circuit (−R) 301 is configured to drive the gate of pass transistor M7. For example, in one embodiment, a current from the negative resistance circuit to the control terminal of the pass transistor M7 may decrease as a voltage on the control terminal of the pass transistor (at node n3) decreases. Accordingly, at large load currents or even under conditions where the drain to source voltage (Vds) becomes very small and the voltage at node n3 drops toward ground, negative resistance circuit 301 will produce less current, and thereby advantageously reduce power consumption (e.g., compared to the case of a positive resistance in the form of a diode connected natural MOS transistor). Under low output current conditions, the voltage on node n3 increases and approaches the turn off voltage of transistor M6 (e.g., Vin−Vt). In this case, the current from negative resistance circuit 301 may increase to provide a bleeding current to drive the gate of pass transistor M7, for example. In some embodiments described in more detail below, if the voltage on node n3 increases above Vin−Vt, negative resistance circuit 301 ultimately shuts down and outputs zero, or nearly zero, bleeding current. It may be noted in certain example embodiments that the bleeding current may flow for a pass transistor gate voltage level well above a threshold below Vin. Example implementations of a negative resistance circuit are described in more detail below.

Figure 4:
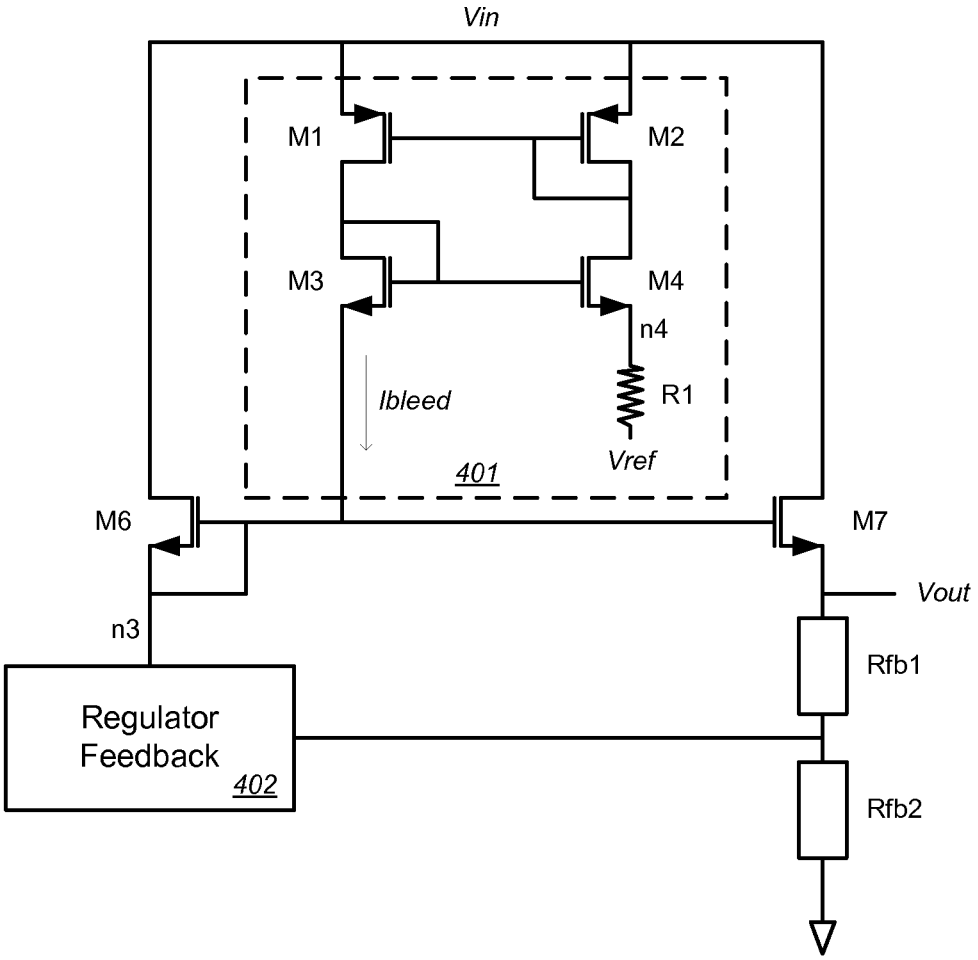
FIG. 4 illustrates an LDO regulator including one example negative resistance circuit according to one embodiment.

FIG. 4 illustrates an LDO regulator including one example negative resistance circuit according to one embodiment. In this example, an LDO regulator comprises a pass transistor M7, feedback resistors Rfb1 and Rfb2, and a regulator feedback control circuit 402. An output of regulator feedback circuit 402 drives diode connected transistor M6 and the gate of pass transistor M7. In this example, a bleeding current is provided by a negative resistance circuit 401 comprising transistors M1, M2, M3, M4, and resistor R1. In this example, a first transistor M3 has a control terminal (e.g., a gate), a first terminal (e.g., a drain), and a second terminal (e.g., a source). The drain of M3 is coupled to the gate of M3 so that M3 is diode connected, for example. The source of M3 is coupled to the control terminal (e.g., a gate) of pass transistor M7. A second transistor M1 has a control terminal (e.g., a gate), a first terminal (e.g., a drain), and a second terminal (e.g., a source). The drain M1 is coupled to the drain and gate of M3. The source of M1 is coupled to input voltage, Vin. A third transistor M2 has a control terminal (e.g., a gate), a first terminal (e.g., a drain), and a second terminal (e.g., a source). The source of M2 is coupled to the input voltage, the drain of M2 is coupled to the gate of M2 so that M2 is diode connected, and the gate of M2 is coupled to the gate of M1. A fourth transistor M4 has a control terminal (e.g., a gate), a first terminal (e.g., a drain), and a second terminal (e.g., a source). The drain of M4 is coupled to the drain of M2, the gate of M4 is coupled to the gate of M3, and the source of M4 is coupled through a resistor R1 to a reference voltage, Vref. In this example, M1-M4 and resistor R1 provide a mechanism for producing a negative resistance bleeding current to node n3.

In this example, the voltage on node n3 at the gate of pass transistor M7 is reflected on node n4 between the source of transistor M4 and a terminal of resistor R1. The other terminal of resistor R1 is coupled to a reference voltage as described in more detail below. In this example, the voltage on the gate of M3 is a Vgs above the voltage on node n3, and the voltage on node n4 is a Vgs below the gate of M4. Since the gate of M3 is coupled to the gate of M4, the voltage on node n3 is approximately the same as the voltage on node n4. Accordingly, the voltage on node n3 sets a voltage across resistor R1 to produce a current through R1, M4, and M2. Transistors M1-M4 mirror the current from resistor R1 to node n3, which forms the bleeding current, Ibleed. As the voltage on node n3 decreases (for nominal output currents), the voltage across R1 decreases, and the bleeding current decreases. As the voltage on n3 increases toward Vin−Vt (for low output current), the bleeding current increases as M6 starts to turn off. If the voltage on node n3 is increased further toward Vin, transistors M1-M4 will shut down and the bleeding current will go to zero.

Figure 5B:
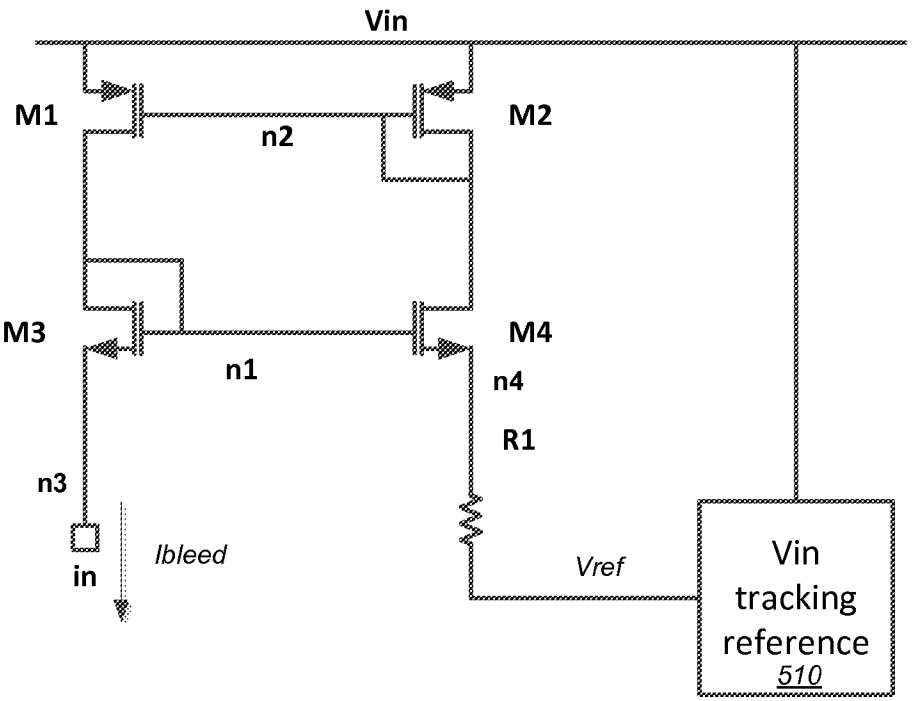
FIG. 5B illustrates another example implementation of a negative resistance circuit according to one embodiment.
Figure 5A:
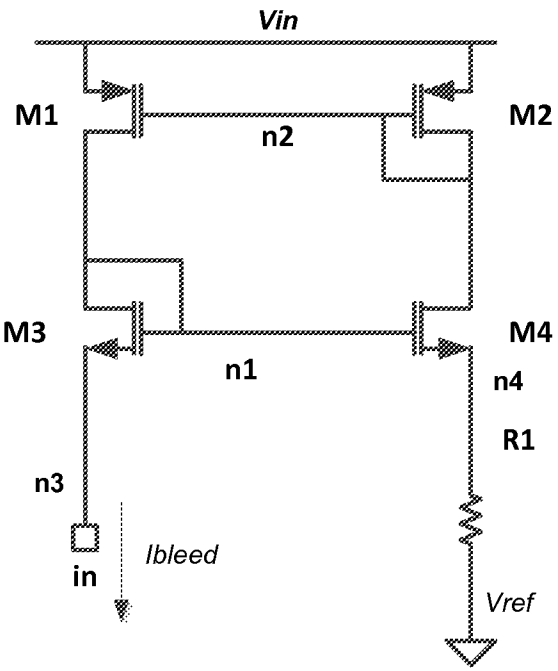
FIG. 5A illustrates one example implementation of a negative resistance circuit according to one embodiment.

FIGS. 5A and 5B illustrates example implementations of a negative resistance circuit according to various embodiments. In one embodiment, the reference voltage for resistor R1 is ground as illustrated in FIG. 5A. However, in some applications Vin may vary during operation. For example, Vin may be generated by a battery, which may vary over time as the battery is charged and discharged, for example. Variations in Vin may alter the performance of the negative resistance circuit and change the bleeding current. Accordingly, in one embodiment, the reference voltage is a constant reference voltage that tracks the input voltage. FIG. 5B illustrates such an embodiment where resistor R1 is coupled to a reference generator circuit (e.g., Vin tracking reference 510) that maintains a constant voltage difference between the input voltage, Vin, and the reference voltage, Vref, for example. In another embodiment, the reference voltage is ground referenced and may not fixed, but may be a function (e.g. non linear function) of the current through the resistor. For example, in one embodiment, the resistor is coupled to a diode (e.g., a diode configured MOS transistor) to ground.

Figure 6:
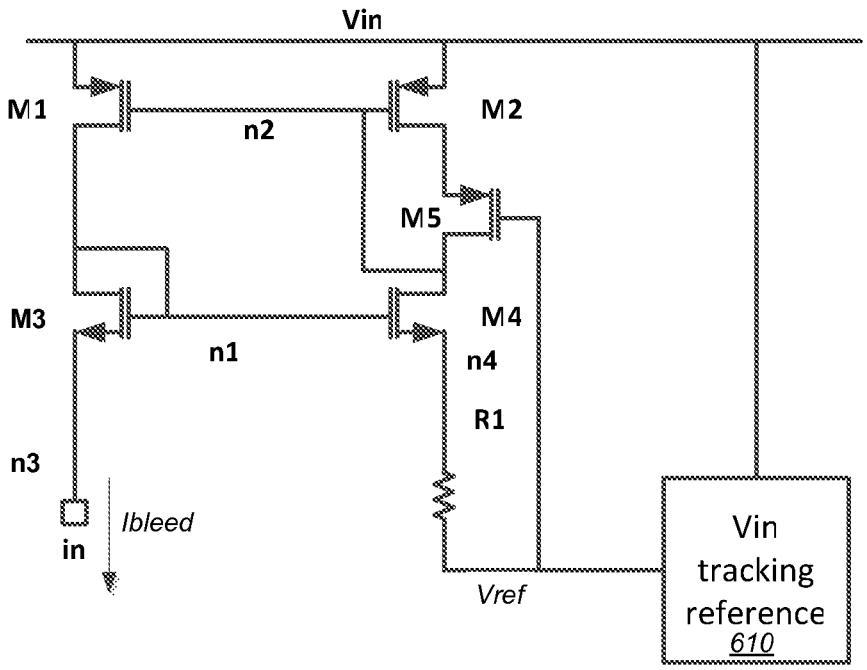
FIG. 6 illustrates yet another example implementation of a negative resistance circuit according to one embodiment.

FIG. 6 illustrates yet another example implementation of a negative resistance circuit according to one embodiment. In this example, an additional transistor M5 is included in the negative resistance circuit. Input impedance of the negative resistance circuit at node n3 may impact performance. M5 may increase the loop gain and increase gm at the bleeding current node "in" (i.e., the source of M3). Adding M5 also achieves closer Vds matching between M1 and M2. Further, the increased gain makes the input impedance seen at "in" smaller which provides for a more stable or fixed reference. In one example implementation, the same bleeding current for the configuration shown in FIG. 6 (including M5) may have a larger gm and better compensation for the LDO. The LDO may exhibit a larger phase margin, for example.

Figure 7:
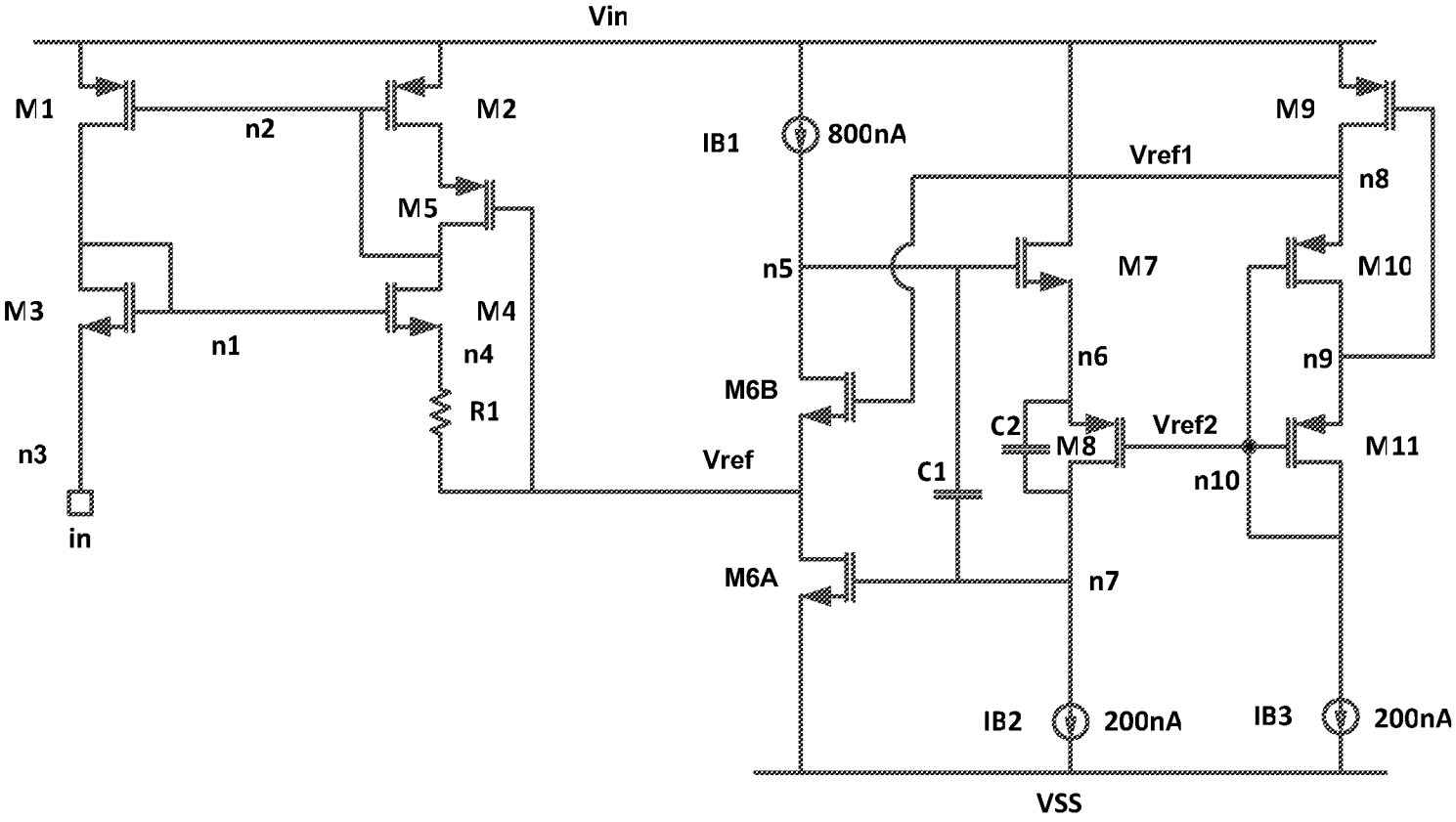
FIG. 7 illustrates an example of a negative resistance circuit and a voltage reference generator according to another embodiment.

FIG. 7 illustrates an example of a negative resistance circuit and a voltage reference generator according to another embodiment. The example voltage reference generator shown in FIG. 7 includes transistors M6A, M6B, M7, M8, M9, M10, and M11 configured as shown. A reference voltage Vref is set by the voltage at the source of M6B. M6A, M7, and M8 comprise a current feedback loop around a source follower M6B and make the input impedance very low. Vref is a Vgs of M6B below Vref1, which in turn is a voltage drop (across M9) lower than Vin. The Vgs of M6B is constant because it is biased by a constant current source IB1. Vref1 is a constant voltage drop below Vin because M9 is configured in the linear region and is biased by a constant current IB3, and hence tracks Vin well. M10 and M11 provide the gate bias Vref2 for the gate of M8.

Figure 8:
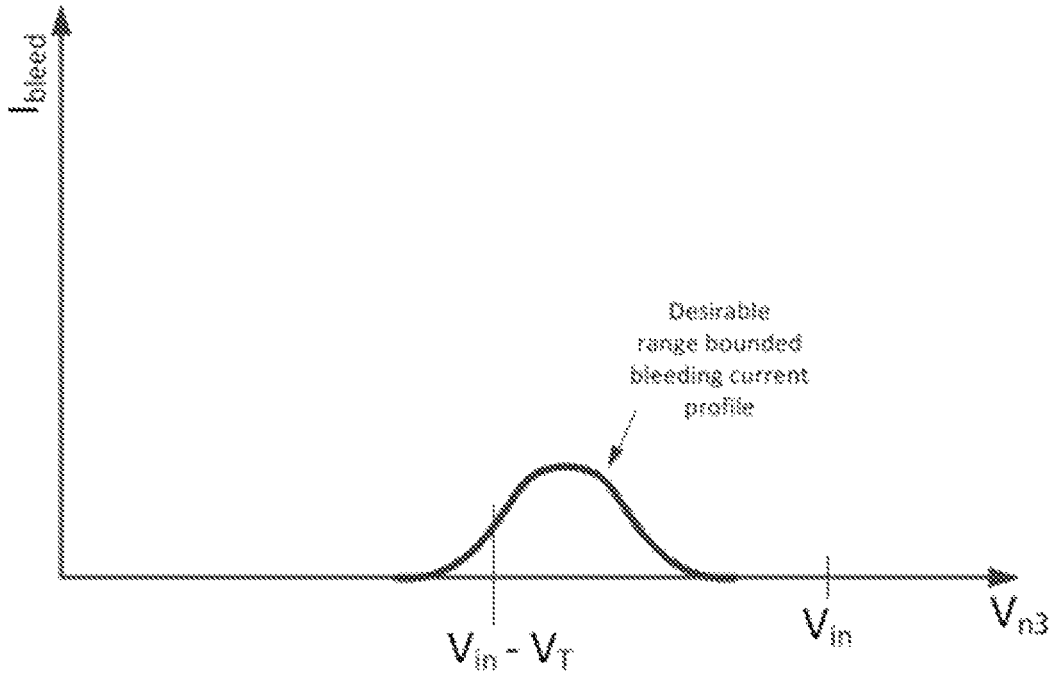
FIG. 8 illustrates a plot of bleeding current versus gate voltage of a pass transistor according to one example embodiment.

FIG. 8 illustrates a plot of bleeding current versus gate voltage of a pass transistor according to one example embodiment. The example circuit shown in FIG. 8 may produce near zero current when the voltage at node n3 is below Vin−Vt. As the voltage on node n3 increases toward Vin−Vt, the bleeding current increases. When the voltage on node n3 increases above Vin−Vt, the bleeding current reaches a maximum value and then starts to turn off as the voltage on node n3 approaches Vin.

The above description illustrates various embodiments of the present disclosure along with examples of how aspects of the particular embodiments may be implemented. The above examples should not be deemed to be the only embodiments, and are presented to illustrate the flexibility and advantages of the particular embodiments as defined by the following claims. Based on the above disclosure and the following claims, other arrangements, embodiments, implementations and equivalents may be employed without departing from the scope of the present disclosure as defined by the claims.

What is claimed is:

1. A circuit comprising:

a pass transistor having a control terminal, a first terminal, and a second terminal, wherein the first terminal is coupled to receive an input voltage;

a regulator feedback control circuit having a first input coupled to the second terminal of the pass transistor and an output coupled to the control terminal of the pass transistor; and a negative resistance circuit coupled to the control terminal of the pass transistor, the negative resistance circuit comprises:

a first transistor having a control terminal, a first terminal, and a second terminal, wherein the first terminal is coupled to the control terminal and the second terminal is coupled to the control terminal of the pass transistor;

a second transistor having a control terminal, a first terminal, and a second terminal, wherein the first terminal is coupled to the first terminal of the first transistor and the second terminal is coupled to the input voltage;

a third transistor having a control terminal, a first terminal, and a second terminal, wherein the first terminal is coupled to the control terminal, the second terminal is coupled to the input voltage, and the control terminal of the third transistor is coupled to the control terminal of the second transistor;

a fourth transistor having a control terminal, a first terminal, and a second terminal, wherein the second terminal is coupled to the second terminal of the third transistor, the control terminal is coupled to the control terminal of the first transistor, and the first terminal is coupled through a resistor to a reference voltage;

a fifth transistor having a control terminal, a first terminal, and a second terminal, wherein the control terminal is coupled to the reference voltage, the first terminal is coupled to the control terminal of the third transistor and the first terminal of the fourth transistor, and the second terminal is coupled to the first terminal of the third transistor.

2. The circuit of claim 1 wherein a current from the negative resistance circuit to the control terminal of the pass transistor decreases as a voltage on the control terminal of the pass transistor decreases below a first value.

3. The circuit of claim 2 wherein the current from the negative resistance circuit to the control terminal of the pass transistor increases as a voltage on the control terminal of the pass transistor approaches a threshold voltage below the input voltage.

4. The circuit of claim 3 wherein the current from the negative resistance circuit to the control terminal of the pass transistor decreases as a voltage on the control terminal of the pass transistor approaches the input voltage.

5. The circuit of claim 1 wherein the reference voltage is ground.

6. The circuit of claim 1 wherein the reference voltage is a constant reference voltage that tracks the input voltage.

7. The circuit of claim 1 wherein the resistor is coupled to a reference generator circuit that maintains a constant voltage difference between the input voltage and the reference voltage.

8. The circuit of claim 7, the reference generator circuit comprising:

a source follower having an input and an output, wherein the input is coupled to a second reference voltage that tracks the input voltage and the output is coupled to the resistor to produce the reference voltage; and a plurality of transistors comprising a current feedback loop around the source follower to produce a low impedance at the output of the source follower.

9. A method comprising:

coupling an input voltage from a first terminal of a pass transistor to produce an output voltage on a second terminal of the pass transistor;

coupling the output voltage to a regulator feedback control circuit having a first input coupled to the second terminal of the pass transistor and an output coupled to a control terminal of the pass transistor; and generating a bleeding current from a negative resistance circuit to a node coupled to the control terminal of the pass transistor, wherein generating the bleeding current comprises:

generating a voltage on a first terminal of a resistor approximately equal to a voltage on the node, and in accordance therewith, generating a resistor current; and mirroring the resistor current to the node, wherein a second terminal of the resistor is coupled to a constant reference voltage that tracks the input voltage.

10. The method of claim 9 wherein the bleeding current from the negative resistance circuit to the node decreases as a voltage on the node decreases.

11. The method of claim 10 wherein the bleeding current from the negative resistance circuit to the node increases as a voltage on the node approaches a threshold voltage below the input voltage.

12. The method of claim 11 wherein the bleeding current from the negative resistance circuit to the node decreases as a voltage on the node approaches the input voltage.

13. The method of claim 9 wherein a second terminal of the resistor is coupled to ground.

14. A circuit comprising:

pass transistor means for receiving an input voltage and producing an output voltage;

feedback control means for receiving the output voltage and controlling a control terminal of the pass transistor means to regulate the output voltage; and means for producing a negative resistance bleeding current to a node coupled to the control terminal of the pass transistor means, wherein means for producing the negative resistance bleeding current comprises:

means for reflecting a voltage on the node to a first terminal of a resistor to generate a resistor current; and means for mirroring the resistor current to the node;

means for generating a constant reference voltage that tracks the input voltage on a second terminal of the resistor.

* * * * *